US006029855A

United States Patent [19]

Adams

[11] Patent Number: 6,029,855

[45] Date of Patent: Feb. 29, 2000

[54] CAP AND FIGURINE DEVICE

[76] Inventor: Douglas W. Adams, 2588 S. Dahlia, Denver, Colo. 80222

[21] Appl. No.: 09/250,418

[22] Filed: Feb. 16, 1999

[51] Int. Cl.[7] ..... B67D 3/00

[52] U.S. Cl. ..... 222/78; 222/525

[58] Field of Search ..... 222/78, 525

[56] References Cited

U.S. PATENT DOCUMENTS 2,805,001 9/1957 Biederman ..... 222/525

5,489,050 2/1996 Finkiewicz et al. ..... 222/525

*Primary Examiner*—Philippe Derakshani

*Attorney, Agent, or Firm*—Ancel W. Lewis, Jr.

[57] ABSTRACT

A cap and figurine device disclosed has a main member with a throughbore and includes a lower coupling portion suitable for threading externally onto a bottle top, an intermediate hollow, elongated neck portion and an upper inner valve portion. A movable outer valve portion moves on the inner valve portion between open and closed positions and is removable from the main member to enable one of a plurality of interchangeable figurines to be placed on and carried by the neck portion which serves as a spindle with the movable outer valve portion retaining the figurine body in place during use.

14 Claims, 2 Drawing Sheets

CAP AND FIGURINE DEVICE

TECHNICAL FIELD

This invention relates to bottle caps and more particularly to a novel combination bottle cap and figurine device.

BACKGROUND ART

Caps for plastic bottles are in common use. A conventional bottle cap has a movable valve portion that moves axially on a stationary valve portion between an open position and a closed position. The present invention provides an added feature to such valved bottle caps of providing interchangeable figurine bodies that may represent many things including sports teams, sports balls or a well known character, an animal, a fish and the like.

DISCLOSURE OF THE INVENTION

A bottle cap and figurine device disclosed has a main member including a lower coupling portion, an intermediate elongated neck portion, and an upper inner valve portion with a flow discharge outlet. An outer valve portion movable on the inner valve portion controls flow through a flow outlet. The outer valve portion is removable from the inner valve portion. One of a plurality of interchangeable figurines is rotatably supported on the neck portion, is retained on the main body by the outer valve portion during use and is removable for replacement with the same or another figurine when the outer valve portion is removed.

BRIEF DESCRIPTION OF THE DRAWINGS

Details of this invention are described in connection with the accompanying drawings which like parts bear similar reference numerals in which.

DETAILED DESCRIPTION

Figure 1:
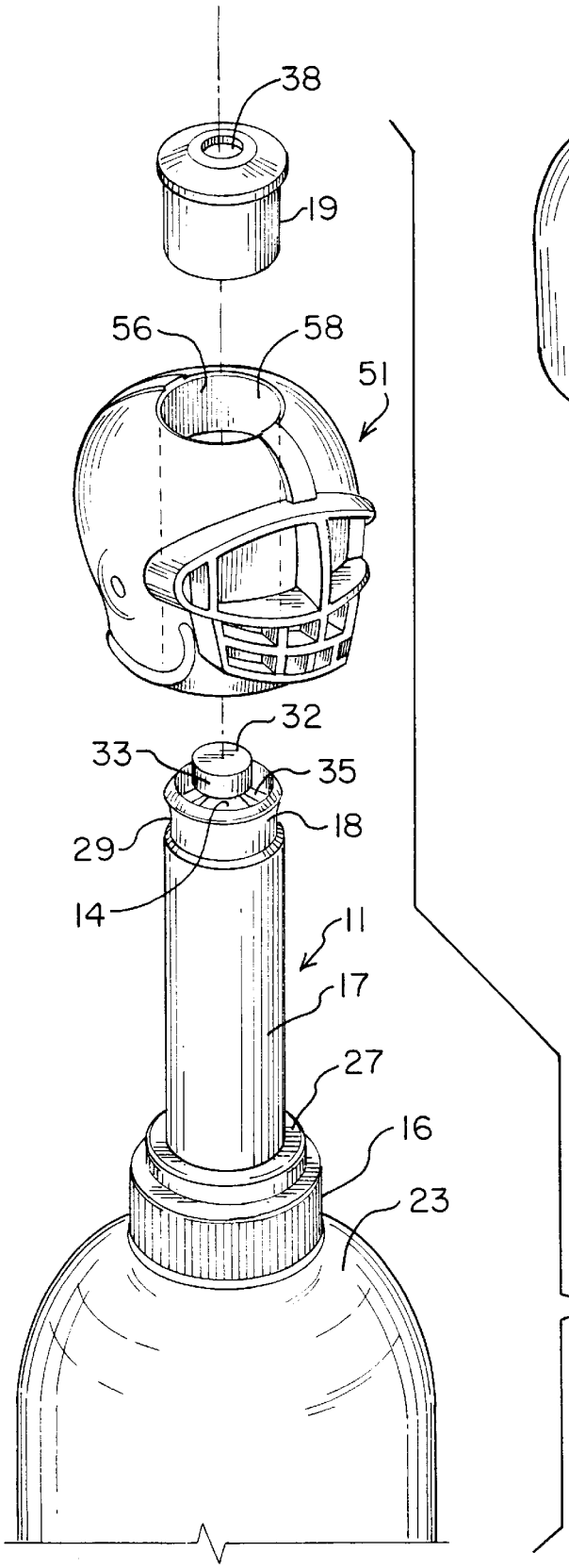
FIG. 1 is an exploded view of a bottle cap and interchangeable figurine device.
Figure 4:
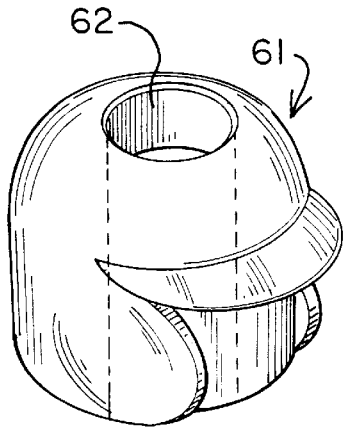
FIG. 4 is a perspective view of an alternative interchangeable figurine.

Referring now to the drawings, there is shown an elongated hollow main member 11 with a throughbore 12, a flow inlet 13 at the lower end and flow outlet 14 at the upper end. The main member 11 has a lower coupling portion 16, an intermediate neck portion 17 extending up from the lower coupling portion, and an upper inner valve portion 18 extending up from the neck portion. An outer valve portion 19 moves on the inner valve portion between a closed position (FIG. 2) and an open position (FIG. 3) and is removable from the main member 11 by the application of an extra axially directed pulling force.

The coupling portion 16 is in the form of a hollow bottle cap having internal threads 22 to thread on the bottle top 23 and has a ribbed, roughened or knurled external surface 24 to avoid slip during turning.

The intermediate neck portion 17 is in the form of a cylindrical tube or pipe of a uniform diameter throughout its length with a smooth exterior surface 26. An enlarged portion forms step 27 between the neck portion 17 and the top of the lower coupling portion 16 providing a flat seating surface on which a figurine described hereinafter is seated.

The inner valve portion 18 has a cylindrical tubular or hollow inner valve body 28 that is an extension of the neck portion 17 and has an annular groove 29 formed a distance axially inward of the upper end of the valve body 28 to form a radially outwardly extending annular knob or raised portion 31.

The raised portion 31 is V-shaped having a tapered inner end surface 31A that serves as a stop surface and cooperates with surfaces on the outer valve portion described hereafter to retain or lock the valve in the closed and in the open position.

A solid disc-shaped end closure member 32 of smaller diameter than the inner valve body 28 and neck portion 17 is provided at the upper end of main member 11. End closure member 32 is supported by three circumferentially spaced radial arms 35 at 120 degree intervals connecting between the inside of the valve body 28 and end closure member 32. The flow outlet 14 is divided into three axial passages between the inside of the valve body 28, axial peripheral inner sealing surface 33 of the end closure member and the arms 35.

The outer valve portion 19 is in the form of a hollow head or cap having a tubular or hollow cylindrical outer valve body 36 and an end cap 37 traversing one end having a discharge opening 38 defined by an axial outer sealing surface 39 and the other end is open.

Figure 2:
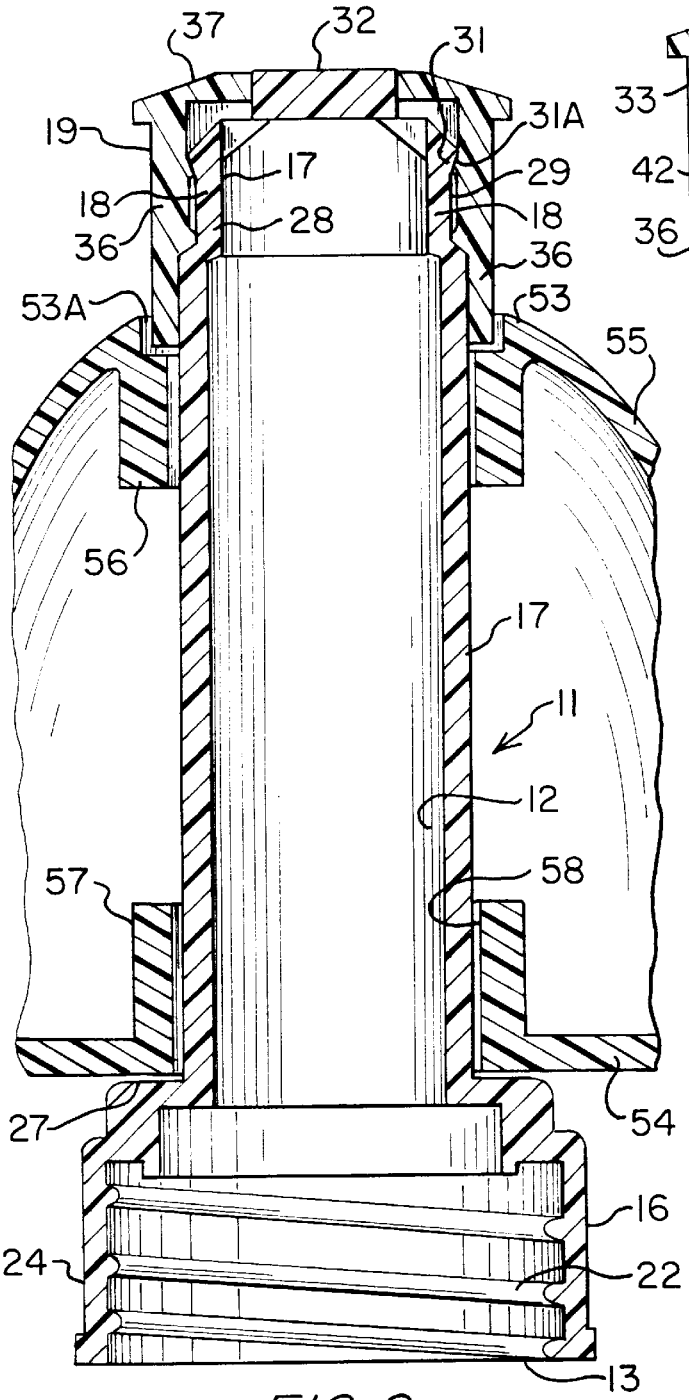
FIG. 2 is a vertical sectional view of the device shown in FIG. 1 with the valve in the closed position.
Figure 3:
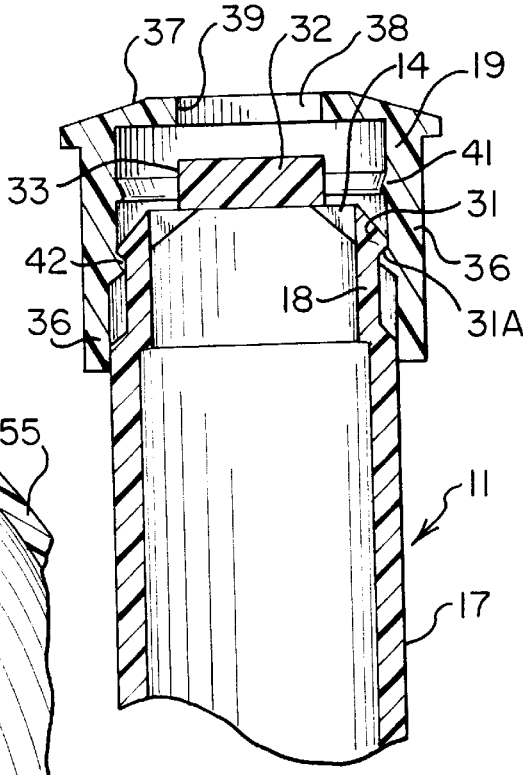
FIG. 3 is a vertical sectional view of an upper portion of the device shown in FIG. 1 with the valve in the open position.

The outer valve portion 19 has a radially inwardly extending annular raised portion 41 inside outer valve body 36 that is positioned under surface 31B in the closed position to hold, retain or lock the outer valve portion 19 in the closed position (FIG. 2). A second inwardly extending annular raised portion 42 is positioned an axial distance below raised portion 31 and is under surface 31A to hold or retain the outer valve portion 19 in the open position (FIG. 3) when an additional axial force is applied to outer valve portion 19 raised portion 42 will clear raised portion 31.

An interchangeable figurine 51 is carried on the neck portion. Figurine 51 shown is a miniature football helmet with a curved top wall 53, flat bottom wall 54 and curved side walls 55. Internal top and bottom flanges 56 and 57 define an internal bore 58 that telescopes over the neck portion and is sized to be in a close fitting relationship and rotatable on the neck portion to any angular position. While hollow figurine bodies are shown it is understood they could be solid. A recess 53A is provided in top wall 53 to receive the lower end portion of valve portion 19. The outer valve portion 19 is removable from the upper valve portion and allows one of a plurality of selected figurine bodies to be carried on the head. A second figurine 61 shown is of a similar construction as figurine 51 having a throughbore 62 but is in the shape of a baseball helmet. Figure 61 is interchangeable with figurine 51 and is held on the neck portion 19 in the same manner. Other figurines may include an animal, fish, notable characters used in commercials, i.e. Santa Claus, Godzilla, etc., or sports balls such as golf ball, football, baseball, etc.

Although the present invention has been described with a certain degree of particularity, it is understood that the present disclosure has been made by way of example and that changes in details of structure may be made without departing from the spirit thereof.

What is claimed is:

1. A cap and figurine device for a bottle comprising:

a main member having a throughbore with a flow inlet and a flow outlet, said member including a lower coupling portion for removably fastening to a bottle top, an intermediate elongated neck portion extending up from said coupling portion, an upper inner valve portion extending up from said neck portion, and an outer valve portion movable on said inner valve portion between closed and open positions, and a figurine carried on said neck portion having a body with an internal bore sized to telescope over said neck portion, said figurine body being retained on said neck portion by said outer valve portion and being removable from said neck portion upon the removal of said outer valve portion from said main body.

2. A device as set forth in claim 1 wherein said inner and outer valve portions have means for retaining said outer valve portion in each of said closed and open positions, said means for retaining including a first radially outwardly extending raised portion on said inner valve portion and a radially inwardly extending raised portion on an inner side of said outer valve portion to retain said outer valve portion in said closed position.

3. A device as set forth in claim 2 wherein said means for retaining includes a second radially outwardly extending raised portion on said inner valve portion axially spaced downwardly from said first raised portion for retaining said outer valve portion in said open position.

4. A device as set forth in claim 1 wherein said lower coupling portion has internal threads for threading on a bottle top and has a roughened outer peripheral surface.

5. A device as set forth in claim 1 wherein said neck portion is in the form of a cylindrical tube of uniform diameter throughout its length and has a smooth peripheral surface.

6. A device as set forth in claim 5 further including an enlarged step portion between said lower coupling portion and the lower end of said tube providing a seating surface for said figurine body.

7. A device as set forth in claim 5 wherein said inner valve portion is an extension at an end of said tube to provide a hollow inner valve body and has an end closure member with circumferentially spaced arms connecting between said end closure member and said inner valve body for supporting said end closure member with exit flow passages between said arms defining said flow outlet, said end closure member having a first axial peripheral sealing surface.

8. A device as set forth in claim 7 wherein said outer valve portion has an outer valve body and a cap over one end having a discharge opening.

9. A device as set forth in claim 8 wherein said cap has a second axial sealing surface defining said discharge opening that is opposite said first axial sealing surface in said closed position.

10. A device as set forth in claim 1 wherein said figurine body has a top wall portion having an annular upper flange portion extending down from said top wall portion defining an upper part of said internal bore, said figurine body having a bottom wall portion with an annular lower flange portion extending up from said bottom wall portion defining a lower part of said internal bore.

11. A device as set forth in claim 10 wherein said figurine body has a top annular recess sized to telescopically receive a lower end portion of said outer valve portion.

12. A device as set forth in claim 1 wherein said figurine body is in the shape of a miniature football helmet.

13. A device as set forth in claim 1 wherein said figurine body is in the shape of a miniature baseball helmet.

14. A bottle cap and figurine device for a bottle comprising:

an elongated hollow main member having a throughbore with a flow inlet and a flow outlet, said main member including a lower coupling portion for removably fastening to a bottle top, an intermediate elongated neck portion extending up from said coupling portion, an upper inner valve portion extending up from said neck portion, and an outer valve portion movable on said stationary valve portion between a closed position and an open position to stop and to control flow through said outlet, said inner and outer valve portions having means for locking said outer valve portion from sliding off from said main member by the application of a nominal pulling force, said outer valve portion being removable from said main body by the application of an extra axial pulling force, and one of a plurality of interchangeable figurines carried on said neck portion, each said figurine having a body with an internal bore sized to telescope over said neck portion and is in a close fitting relationship and rotatable on said neck portion to any selected angular position, said figurine body being retained on said neck portion by said outer valve portion and being removable from said neck portion upon the removal of said outer valve portion for replacement by another of said figurine bodies.

* * * * *